US006164496A

United States Patent [19]

Gregory

[11] Patent Number: 6,164,496

[45] Date of Patent: Dec. 26, 2000

[54] SOAP DISPENSING MECHANISM

[76] Inventor: Jack T. Gregory, 100 Reed Blvd., Mill Valley, Calif. 94941

[21] Appl. No.: 09/366,506

[22] Filed: Aug. 3, 1999

Related U.S. Application Data

[63] Continuation-in-part of application No. 09/315,862, May 20, 1999, abandoned

[60] Provisional application No. 60/086,351, May 20, 1998.

[51] Int. Cl.[7] ..... A46B 11/00

[52] U.S. Cl. ..... 222/144.5; 239/315; 239/316

[58] Field of Search ..... 222/144.5, 145.5, 222/145.7, 630; 401/270, 289; 134/99.2; 239/315, 316, 318

[56] References Cited

U.S. PATENT DOCUMENTS

| | | | |
|---|---|---|---|
| 2,620,234 | 12/1952 | Schaich | 239/315 X |
| 2,797,132 | 6/1957 | Alpert | 239/315 X |
| 2,908,445 | 10/1959 | Schwartz | 239/315 X |
| 2,975,804 | 3/1961 | Dunn et al. | 239/315 X |
| 3,145,735 | 8/1964 | Osrow et al. | 239/316 X |
| 3,275,194 | 9/1966 | Moulder | 239/316 X |
| 4,009,831 | 3/1977 | Arad et al. | 239/315 |
| 4,171,169 | 10/1979 | Williams | 239/315 X |
| 4,575,270 | 3/1986 | Hammond | 401/289 X |
| 4,767,059 | 8/1988 | Crapser et al. | 222/144.5 X |
| 4,858,830 | 8/1989 | Proctor et al. | 239/315 X |
| 4,875,626 | 10/1989 | Buhler et al. | 239/315 X |
| 5,988,911 | 11/1999 | Browne, Jr. et al. | 239/315 X |

*Primary Examiner*—Kenneth Bomberg
*Attorney, Agent, or Firm*—Hovey, Williams, Timmons & Collins

[57] ABSTRACT

A dispensing valve unit (12) is provided (which may be a part of a cleaning brush unit (10)) having a stationary inner tubular assembly (22), a telescopically interfitted shiftable outer tubular assembly (24) and an inner dual valve assembly including valve body (26) operatively coupled with the outer assembly (24) and engageable with a shoulder (48) forming a part of the inner tubular assembly (22). The inner assembly (22) has a soap entry port (54) through a wall thereof, whereas the outer assembly (24) is equipped with a portion (90) adjacent the port (54) and having an opening (92) therethrough which is selectively registrable with the port (54). A cam mechanism (40, 80) between the inner assembly (22) and outer assembly (24) effects axial shifting of the outer assembly (24) upon rotation thereof. The outer assembly (24) is selectively shiftable so that the unit (12) may assume three different positions: a soap and low volume water delivery position wherein the opening (92) is in registry with the port (54) so that soap is drawn from an annular reservoir (112) formed between the assemblies (22, 24), and valve body (26) is shifted to permit controlled water flow therethrough so that soap and water are mixed for dispensing; a high volume water-only rinse position where the valve body (26) is shifted from shoulder (48) and portion (90) covers the port (54); and an all-off position where the valve body (26) engages shoulder (48) and prevents water flow through the valve body (26), and the portion (90) covers the port (54).

10 Claims, 3 Drawing Sheets

SOAP DISPENSING MECHANISM

RELATED APPLICATION

This is a continuation-in-part of application Ser. No. 09/315,862 filed May 20, 1999, now abandoned which claims the benefit of the provisional application Ser. No. 60/086,351, filed May 20, 1998.

BACKGROUND OF THE INVENTION

1. Field of the Invention

The present invention is broadly concerned with a soap dispensing valve unit and overall cleaning brush assembly which is designed to be connected to a source of pressurized water(typically a conventional garden hose) and which can be user-selected to deliver a mixture of liquid soap and low-volume water, high-volume full-pressure rinse water only, or to be shut off entirely. More particularly, the invention pertains to such a soap dispensing valve unit and brush wherein the valve unit includes a pair of partially interfitted, relatively movable tubular assemblies with an annular soap reservoir therebetween, such that the tubular assemblies can be relatively positioned at discrete locations for the respective user-selected delivery options. The internal valve system of the unit is made up of two valves so as to control water volume and pressure in the low volume and high volume settings.

2. Description of the Prior Art

Traditional at-home car washing involves initially rinsing the car with water from a garden hose, followed by application of soap using rags or brushes, with a final rinse and dry. In like manner, cleaning of exterior walls, decks or lawn furniture has commonly been carried out in much the same way.

It has been known in the past to provide hose-mounted washing heads or brushes to facilitate these types of cleaning. These are generally designed so that water from the hose passes through the cleaning head or brush bristles. In many cases, prior devices of this character have included a soap reservoir which can be manually opened to permit soap to be drawn therefrom and mixed with water, so that a soap-water mixture is delivered through the head or bristles. However, soap-dispensing devices of this type have tended to operate poorly as the user had to regulate water and soap flows manually. Such prior devices also lack full functionality allowing the user to easily select between low-volume soap and water dispensing, full-volume water-only rinse dispensing, and all-off (no soap or water dispensed). low-volume soap and water dispensing, full-volume water-only rinse dispensing, and all-off (no soap or water dispensed).

SUMMARY OF THE INVENTION

The present invention overcomes the problems outlined above, and provides an improved dispensing valve unit adapted for coupling with a source of pressurized water and permitting the user to selectively deliver a controlled low-volume water-soap mixture or high-pressure full-volume water only to a restricted dispensing outlet, or entirely prevent delivery of soap or water to the dispensing outlet. Broadly speaking, the valve unit of the invention includes a pair of at least partially telescopically interfitted inner and outer tubular assemblies forming therebetween a reservoir for liquid soap, with a shiftable pair of valves located within the inner tubular assembly. The inner tubular assembly provides a through-passage for pressurized water, i.e., the rearmost end of the inner section is coupled to the water source, whereas the forward end thereof is coupled with a delivery outlet such as a restricted pipe or the like.

The tubular assemblies are mounted for selective relative movement therebetween and are operatively coupled with the valve body to permit adjustment of the unit between three operating positions: a soap and low-volume water delivery position wherein the valve body is shifted to permit water flow therethrough and soap from the reservoir is permitted to pass via a soap entry port into the interior of the inner tubular assembly for mixture with the water passing therethrough; a full-volume water-only rinse position wherein the soap entry port is blocked and only water passes through the inner tubular assembly; and an all-off position wherein both water and soap is prevented from passing through the inner tubular assembly.

In preferred forms, the outer tubular assembly is mounted for rotation relative to the inner tubular assembly, and a cam mechanism interconnects the two assemblies so that upon such rotation the outer tubular assembly is moved axially relative to the inner tubular assembly. The outer tubular assembly is equipped with a wall adapted for selectively closing the soap entry port forming a part of the inner tubular assembly. Thus, when the assembly is in the water-only rinse position or the all-off position, the wall covers the soap entry port and prevents entry of liquid soap into the inner tubular assembly.

DETAILED DESCRIPTION OF THE PREFERRED EMBODIMENT

Figure 1:
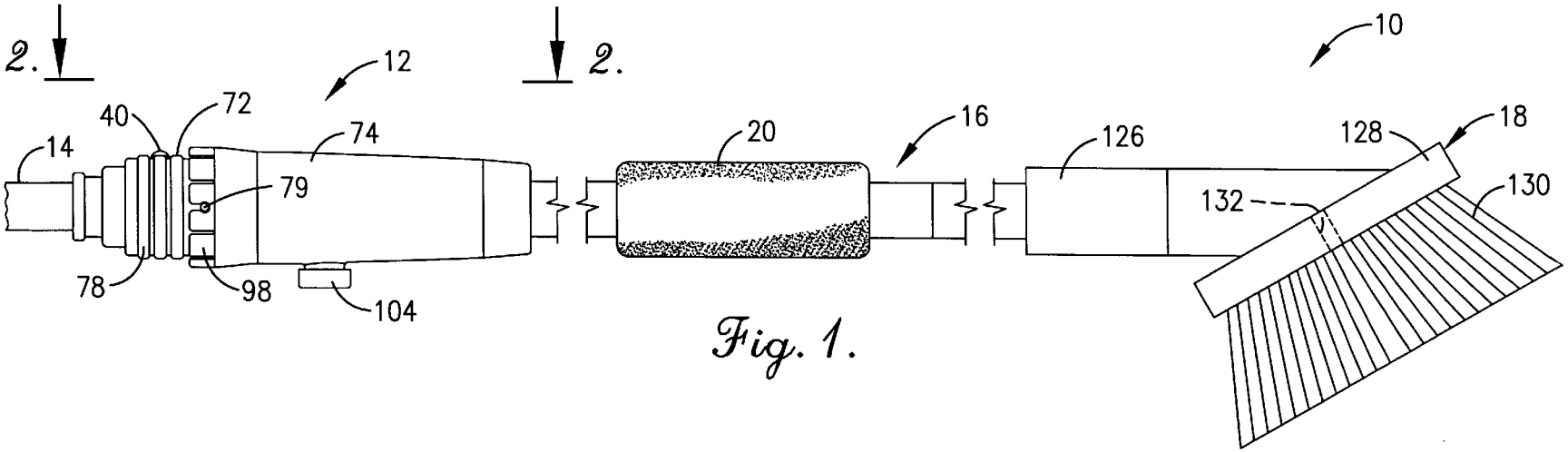
FIG. 1 is a fragmentary side view of a preferred soap dispensing brush in accordance with the invention, shown connected to a hose.

Turning now to the drawings and particularly FIG. 1, a soap dispensing brush unit 10 is illustrated. The brush unit 10 includes a dispensing valve assembly 12 adapted to be coupled with a hose 14, as well as a forwardly extending, multiple-section telescopic tubular delivery pipe 16 supporting an obliquely oriented brush 18. The delivery pipe 16 is operatively coupled with the valve assembly 12, and includes a resilient handle pad 20 between the valve assembly 12 and brush 18. In broad terms, the brush unit 10 is designed to hold a supply of liquid soap and to be selectively shiftable between three positions, namely a soap-dispensing position where a mixture of water and soap is delivered to the brush 18, a totally off position where neither water nor soap is delivered, and a rinse position wherein only water is delivered to brush 18.

The valve assembly 12 includes an inner stationary assembly 22, an outer shiftable assembly 24, and an innermost dual valve mechanism including shiftable valve body 26.

The inner assembly 22 has a rearmost tubular section 28, an aligned, tubular forward section 30 which is secured to the inner end of delivery pipe 16. The section 28 is integral and formed of synthetic resin material and includes a rearmost, internally threaded connection segment 32 adapted to receive the threaded end 34 of hose 14; to this end, a resilient annular seal 36 is provided adjacent the forward end of the segment 32. Section 28 further includes a forwardly extending, generally frustoconical segment 38 presenting an outwardly extending exterior lobe 40, a circular, outwardly extending ring 42 and axially extending, opposed slots 44. As shown, the forwardmost end of the section 28 terminates in a butt end 46. The section 28 also has an inwardly extending shoulder 48 located between the lobe 40 and ring 42.

Figure 3:
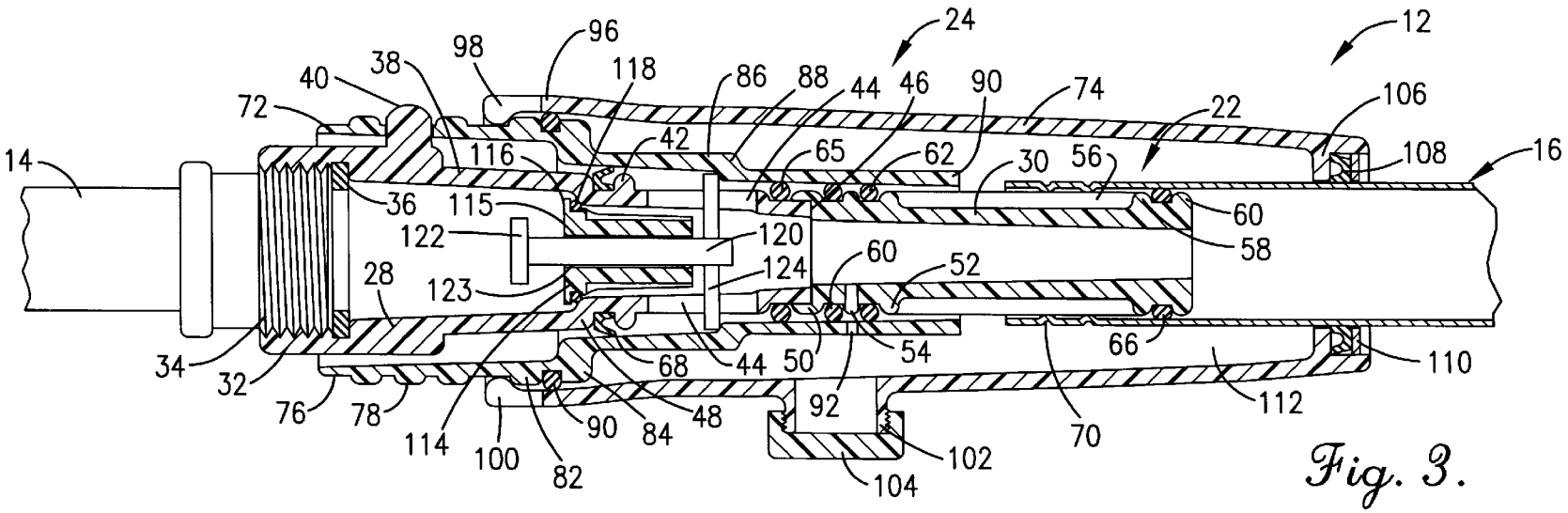
FIG. 3 is a vertical sectional view taken along line 3—3 of FIG. 2 of the dispensing valve assembly, depicting the same in the soap dispensing position thereof.
Figure 4:
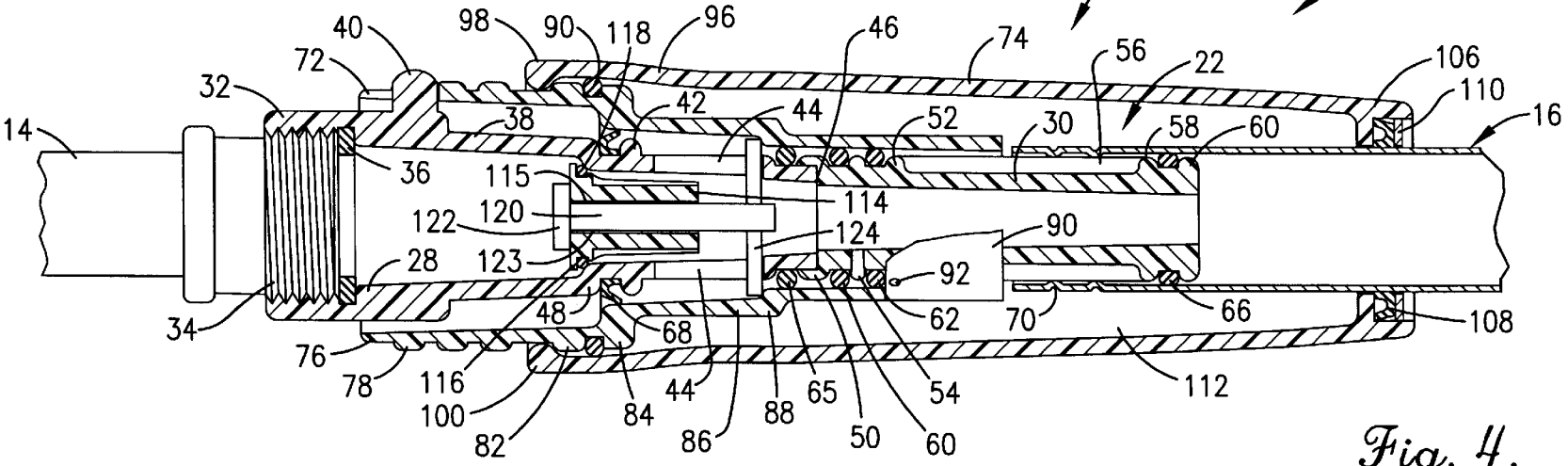
FIG. 4 is a vertical sectional view similar to that of FIG. 3, but showing the dispensing valve assembly in its off position.
Figure 5:
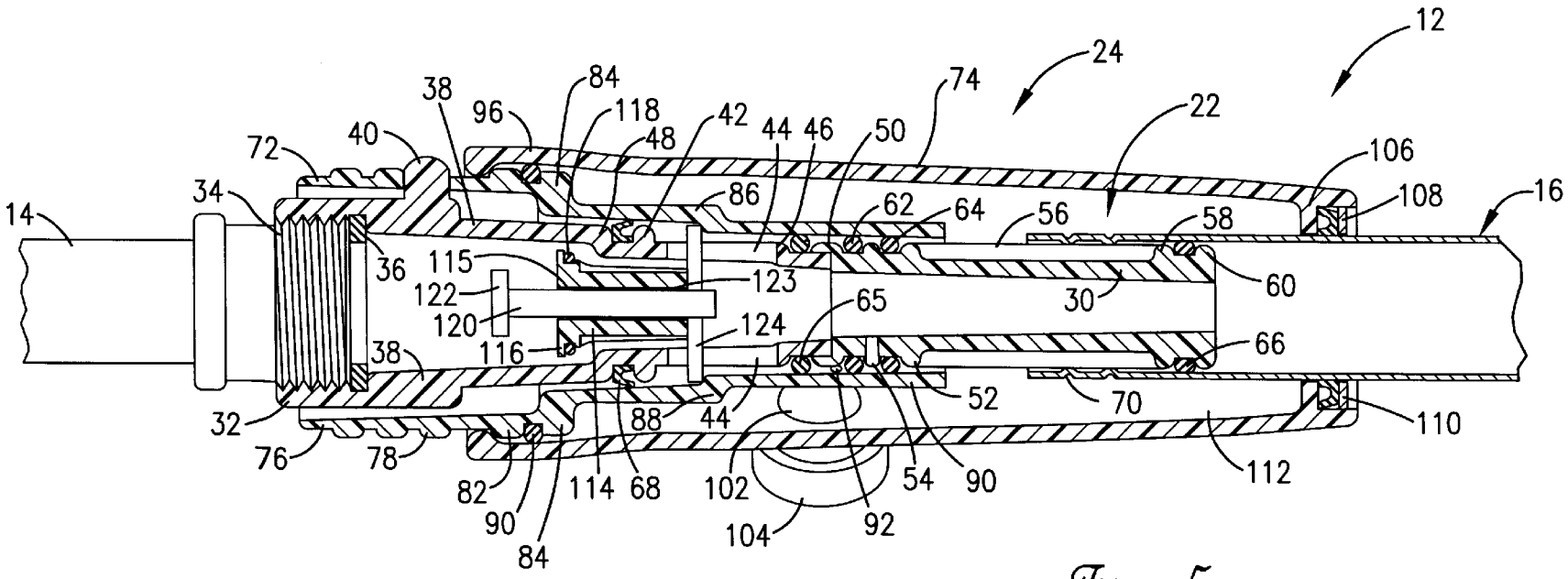
FIG. 5 is a vertical sectional view similar to that of FIG. 3, but showing the dispensing valve assembly in its water rinse position.

The tubular forward section 30 is likewise of integral, synthetic resin construction and is permanently affixed by welding to the butt end 46 of the section 28. The outer surface of the section 30 includes a pair of axially spaced apart, circular outwardly extending projections 50 and 52, with a soap entry port 54 situated between the projections 50, 52. The section 30 also includes a series of external, outwardly extending, circumferentially spaced ribs 56 extending along the length thereof between the projection 52 and the forward end of the section. The forward end of the section 30 has a pair of outer, axially spaced apart, circular, outwardly extending seal-retaining projections 58, 60. Referring to FIGS. 3–5, it will be observed that a pair of O-rings 62, 64 are situated on opposite sides of the port 54, being retained by the projections 50 and 52, and that a third O-ring 65 is located upstream of projection 50. Similarly, an O-ring 66 is located adjacent the forward end of the section 30 between the projections 58, 60. Finally, it will be seen that a circular, U-shaped in cross-section cup-type seal 68 is situated between shoulder 48 and ring 42.

The inner end of pipe 16 is permanently affixed to the section 30 by crimping 70 about the ribs 56. As illustrated, the sections 28 and 30 and pipe 16 are in substantial axial alignment, and are adapted for communication with each other.

Figure 2:
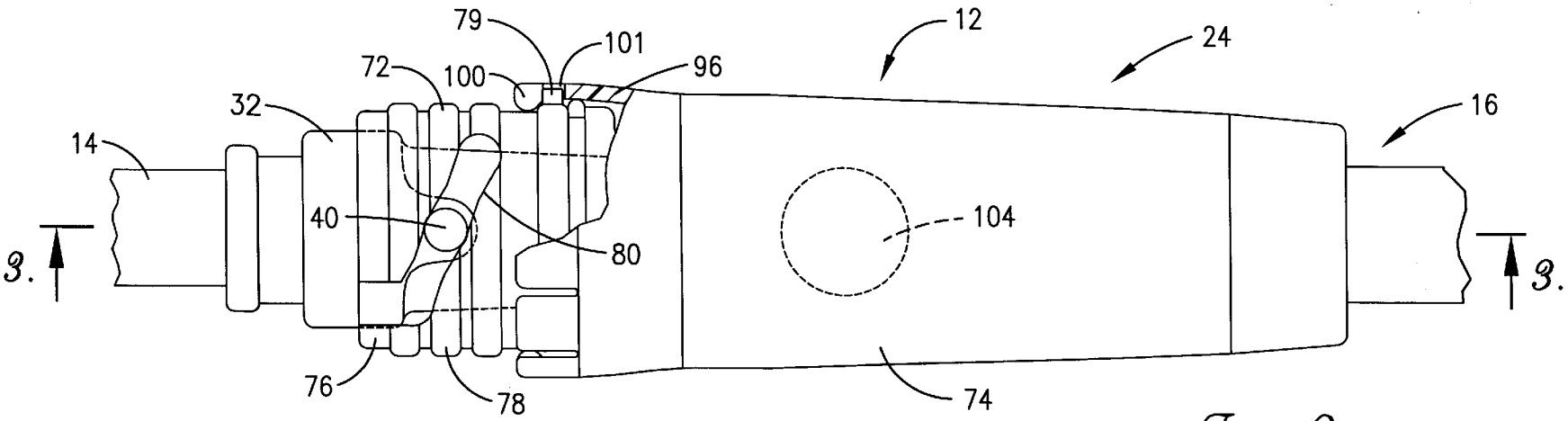
FIG. 2 is an enlarged, fragmentary view taken along line 2—2 of FIG. 1 and with parts broken away for clarity illustrating portions of the dispensing valve assembly of the brush.

The outer shiftable assembly 24 is made up of a rearmost tubular cam sleeve 72 as well as a forwardly extending, outer housing 74. The sleeve 72 is of integral, synthetic resin construction and includes a rearmost segment 76 presenting a series of outwardly projecting, circular, axially spaced ribs 78. The forwardmost rib 78 includes a pair of opposed, outwardly extending locking pins 79 (FIG. 2). The segment 76 also has an elongated, generally fore and aft extending obliquely oriented slot 80 formed therein and bridging the rearward ribs 78; the slot 80 has a rearmost open end 80 which is substantially axial in alignment. The forward end of the sleeve 72 includes a pair of outer, outwardly projecting, seal-retaining projections 82, 84, a radially constricted portion 86 terminating in a shoulder 88, and a forwardmost tubular portion 90 having an opening 92 formed therein. As shown, an O-ring 94 is located between the projections 82, 84.

The housing 74 is of integral, synthetic resin construction and presents a rearmost connection section 96 having a series of circumferentially spaced tabs 98 each having an inwardly extending lobe 100 designed to mate with the projection 82 formed on cam sleeve 72. A pair of opposed openings 101 are also formed in the section 96, and receive the pins 79 forming a part of the inner cam sleeve 72, so that the sleeve 72 and housing 74 rotate in unison. The forward portion of housing 74 includes a threaded liquid soap fill port 102 normally closed by a complementally threaded cap 104. The forwardmost end of the housing 74 has an inwardly extending annular wall 106 which supports a U-shaped in cross-section annular seal 108 and a locking ring 110. The annular space between the forward portion of cam sleeve 72 and pipe 16 within the confines of housing 74 serves as a reservoir 112 for liquid soap.

The valve body 26 includes an elongated, annular unit 114 presenting a through bore 115, and a rear, radially enlarged, bifurcated shoulder 116 supporting an outer sealing ring 118. An elongated valve stem 120 having an enlarged head 122 is slidably located within unit 114 and extends forwardly therefrom. It will be observed that the valve stem 120 is substantially longer than the valve body 114, and that an annular passageway 123 is provided between the outer surface of the valve stem 120 and the inner defining surface of the bore 115. A fixed crosspin 124 is connected to the forward end of valve stem 120 and extends through the slots 44 of section 28 to a point closely adjacent the inner surface of the portion 86 of cam sleeve 72. It will be seen that the shoulder 116 and sealing ring 118 of the valve body 26 are closely adjacent and coact with the shoulder 48 of the stationary tubular section 28.

Insofar as the various sealing rings are concerned, the O-ring 94 provides a seal between the cam sleeve 92 and housing 74; the O-ring 62 and 64 provide seals between the stationary tubular section 30 and the inner surface of tubular portion 90 of cam sleeve 72; O-ring 66 provides a seal between the interconnected tubular section 30 and pipe 16; the seal 108 provides a seal between the housing 74 and pipe 16; and the seal 68 provides a seal between the stationary rear tubular section 28 and the surrounding cam sleeve 72.

Brush 18 is itself entirely conventional, and is mounted upon the outermost end of pipe 16. Specifically, the brush 18 includes a tubular connector 126 supporting an obliquely oriented brush head 128, the latter having conventional bristles 130. An annular opening 132 (FIG. 1) through brush head 128 permits restricted passage of liquid through the brush unit 10 and onto the bristles 130.

The use of brush unit 10 with dispensing valve assembly 12 will now be described with reference to FIGS. 2–5. In this discussion, it will be assumed that the pipe 16 is extended to an appropriate length, and that a hose 14 is threadably coupled with connection segment 32 of tubular section 28. As indicated previously, the valve assembly 12 is movable between three positions, specifically a low water volume soap dispensing position depicted in FIGS. 2 and 3, an all-off position shown in FIG. 4, and a high volume water-only rinse position illustrated in FIG. 5.

Referring first to the all-off position shown in FIG. 4, it will be seen that the valve stem 120 is located in its forwardmost position with the head 122 thereof abutting the rear face of valve body 114 to thus prevent passage of water through the valve body 26 and thus through unit 10. In this position, the sleeve 72 and housing 74 are moved forwardly so that the shoulder 88 of sleeve 72 is located ahead of the slots 44. This permits the shoulder 116 and sealing ring 118 of the valve body 26 to come into full abutting contact with the shoulder 48 of tubular section 28. Water pressure from the hose 14 acting against the head 122 insures that an essentially fluid-tight seal is maintained. In this orientation, opening 92 of tubular portion 90 of sleeve 72 is moved forwardly out of registration with the port 54 and forwardly of the O-ring 64. Thus, soap from reservoir 112 is prevented from passing into the tubular section 30 by virtue of the blocking action of portion 90 and the seal provided by O-ring 64 between the portion 90 and the inner surface of the surrounding tubular portion 90.

If the user then decides to dispense a soap and water mixture, the user grasps housing 74 and rotates it in a clockwise direction from the perspective of FIG. 2. This serves to move the sleeve 72 and housing 74 in unison leftwardly as viewed in FIG. 4 until the soap dispensing position shown in FIGS. 2 and 3 is reached. However, during such movement, the valve head 120 unseats from the rear face of valve body 114, thereby permitting a controlled volume leak of water through the annular passageway 123; the soap entry port 54 also comes into fluidic communication and alignment with opening 92 during such movement. It will be appreciated that the combination of valve body 26 and valve stem 120 provides a first low volume valve.

At the end of the described movement where the unit 10 assumes the FIG. 3 position, it will be observed that the lobe 40 of cam sleeve 72 is located at the approximate center of the oblique cam slot 80, and that the valve body 26 is positioned with sealing ring 18 in sealing engagement with shoulder 48. The crosspin 124 forming a part of the valve body 126 abuts shoulder 88 and is midway along the length of the slots 44. In addition, in the FIG. 3 position, the opening 92 is in full alignment and registration with entry port 54. Thus, water flowing through hose assembly 14 into assembly 12 passes through the annular opening 123 and proceeds through the brush section 30 and into and through pipe 16 towards brush 18. During such passage, liquid soap within reservoir 112 is drawn through the opening 92 and port 54, and is mixed with the controlled volume of water passing through the unit 10. Therefore, a soap/water mixture is delivered to brush 18.

After sufficient soap has been dispensed in the FIG. 3 position, the user may wish to rinse using water only. In order to achieve this, the user grasps housing 74 and rotates it in a counterclockwise direction (from the perspective of the user in FIG. 2). This serves to move the sleeve 72 and housing 74 in unison leftwardly as viewed in FIGS. 2–5, owing to the camming action generated by the interaction of lobe 40 and slot 80, until the FIG. 5 position is reached. In this position, the valve body crosspin 124 abuts shoulder 88 with the crosspin closer to the rearmost ends of the slots 44; this provides a very large annular passageway 134 between the valve body 26 and the shoulder 48, thereby allowing full flow of water from hose 14 through the valve assembly 12 and to pipe 16 and brush 18. Of course, the combination of valve body 26 and shoulder 48 presents a second high volume valve. It will be seen that in the rinse position, the opening 92 of tubular portion 90 of sleeve 72 is offset rearwardly to a point adjacent the projection 50 and rearward of the O-ring 62. In this position, soap within reservoir 112 is prevented from passing through port 54 because of the flow-blocking position of portion 90 and the sealing action of O-ring 60 between the tubular section 30 and the surrounding portion 90. As a consequence, only water passes through the valve assembly 12.

It will thus be seen that the valve assembly 26 allows the operator to selectively and readily shift between the soap dispensing position of FIG. 3 and the alternate full-off and water-only positions depicted in FIGS. 4 and 5 respectively.

I claim:

1. A dispensing valve unit adapted for coupling with a source of pressurized water and permitting the user to selectively deliver a mixture of soap and water or water only to a restricted dispensing outlet, or to prevent delivery of soap or water to said dispensing outlet, said unit comprising:

a pair of at least partially interfitted inner and outer tubular assemblies forming therebetween a reservoir for liquid soap, the inner tubular assembly having an inner valve seat and adapted for connection between said source of pressurized water and said dispensing outlet and having a soap entry port through a wall thereof, the outer tubular assembly disposed at least partially about said inner tubular assembly and having a wall adapted to cover said soap entry port; and a shiftable valve body located within said inner tubular assembly and including an annular element and a valve stem received therein, said valve stem and annular element cooperatively defining a low volume control annular passageway therebetween, said element and valve stem being relatively shiftable, said inner and outer tubular assemblies being mounted for selective relative movement therebetween and permitting selective adjustment of the unit to a soap and water delivery position wherein said valve stem and element are relatively shifted to open said annular passageway in order to permit flow of water therethrough and said soap entry port communicates with said reservoir and permits passage of liquid soap through the soap entry port, to a full volume water-only delivery position wherein said valve body is spaced from said valve seat and said outer tubular assembly wall covers said soap entry port to prevent passage of liquid soap through the soap entry port, and to an all-off position wherein said valve body engages said valve seat, and said element and valve stem are shifted so as to close said annular passageway.

2. The dispensing valve unit of claim 1, said outer tubular assembly being axially shiftable relative to said inner tubular assembly.

3. The dispensing valve unit of claim 1, said outer tubular assembly being rotatable relative to said inner tubular assembly, there being a cam assembly operatively interconnecting said inner and outer tubular assemblies for axial shifting of the outer tubular assembly in response to said rotation thereof.

4. The dispensing valve unit of claim 1, said outer tubular section wall having an opening therethrough, said opening being in communication with said soap entry port when said assembly is in said soap and water delivery position and out of communication with said soap entry port when said assembly is in said water-only and all-off positions.

5. The dispensing valve unit of claim 1, said inner tubular assembly including a rearmost threaded end adapted to receive a hose fitting, said inner tubular assembly having a forward end coupled with a delivery pipe.

6. The dispensing valve unit of claim 1, said outer tubular assembly including a fill port allowing introduction of liquid soap into said reservoir.

7. The dispensing valve unit of claim 1, said inner tubular assembly including a slot formed in a wall thereof, said valve body including a locating pin received within said slot, said locating pin engageable with said outer tubular assembly for locating and maintaining the position of said valve body in said assembly positions.

8. The dispensing valve unit of claim 1, said valve stem having an enlarged head engageable with said element, said element and valve stem being relatively shifted in said all-off position so that said head engages said element and closes said annular passageway.

9. A dispensing valve unit adapted for coupling with a source of pressurized water and permitting the user to selectively deliver a mixture of soap and water or water only to a restricted dispensing outlet, or to prevent delivery of soap or water to said dispensing outlet, said unit comprising:

a pair of at least partially interfitted inner and outer tubular assemblies forming therebetween a reservoir for liquid soap, the inner tubular assembly having an inner valve seat and adapted for connection between said source of pressurized water and said dispensing outlet and having a soap entry port through a wall thereof, the outer tubular assembly disposed at least partially about said inner tubular assembly and having a wall adapted to cover said soap entry port; and first and second valves located within said inner tubular assembly and operatively coupled with at least one of said tubular assemblies, said inner and outer tubular assemblies being mounted for selective relative movement therebetween and permitting selective adjustment of the unit and said first and second valves to a soap and low volume water delivery position wherein a controlled, relatively low volume of water passes through the unit, a full volume water-only delivery position wherein a relatively high volume of water passes through the unit without passage of soap therethrough, and to an all-off position wherein both of said valves are closed.

10. The dispensing valve unit of claim 9, said first valve being open and said second valve being closed in said soap and low volume water delivery position, said second valve being open in said full volume water only delivery position.

* * * * *